US009935380B2

(12) United States Patent
Cheng et al.

(10) Patent No.: US 9,935,380 B2
(45) Date of Patent: Apr. 3, 2018

(54) ANTENNA DEVICE

(71) Applicants: Chih-Jen Cheng, Taipei (TW); Chih-Kai Liu, Hsinchu (TW); Kui-Hsien Huang, Taipei (TW)

(72) Inventors: Chih-Jen Cheng, Taipei (TW); Chih-Kai Liu, Hsinchu (TW); Kui-Hsien Huang, Taipei (TW)

( * ) Notice: Subject to any disclaimer, the term of this patent is extended or adjusted under 35 U.S.C. 154(b) by 0 days.

(21) Appl. No.: 15/181,421

(22) Filed: Jun. 14, 2016

(65) Prior Publication Data

US 2017/0358868 A1 Dec. 14, 2017

(51) Int. Cl.

| | |
|---|---|
| ***H01Q 21/28*** | (2006.01) |
| ***H01Q 21/24*** | (2006.01) |
| ***H01Q 9/04*** | (2006.01) |
| ***H01Q 1/24*** | (2006.01) |
| ***H01Q 21/29*** | (2006.01) |

(52) U.S. Cl.

CPC ..... *H01Q 21/24* (2013.01); *H01Q 1/243* (2013.01); *H01Q 9/0421* (2013.01); *H01Q 21/29* (2013.01); *H01Q 21/293* (2013.01)

(58) Field of Classification Search

CPC ..... H01Q 21/24; H01Q 21/28; H01Q 21/29; H01Q 21/293

See application file for complete search history.

(56) References Cited

U.S. PATENT DOCUMENTS

2006/0152413 A1* 7/2006 Uno ..... H01Q 3/24 343/700 MS

2010/0171675 A1* 7/2010 Borja ..... H01Q 1/38 343/798

* cited by examiner

*Primary Examiner* — Hoang Nguyen

(74) *Attorney, Agent, or Firm* — Leong C. Lei

(57) ABSTRACT

The antenna device includes a first antenna module and a second antenna module. The first antenna module includes a number of first antennas disposed at intervals. The second antenna module includes a number of second antennas disposed at intervals within a space surrounded by the first antennas. The first and second antennas are of different polarization directions. In one embodiment, the first antennas are horizontally polarized antennas having omnidirectional field patterns. The second antennas are inverted F antennas. By arranging the first and second antennas along an outer ring and an inner ring respectively, the distance between the first and second antenna modules are maximized. Furthermore, by having the first and second antennas with orthogonal polarization directions, the mutual interference between the radiation energy of the first and second antenna modules is effectively reduced.

9 Claims, 7 Drawing Sheets

ANTENNA DEVICE

BACKGROUND OF THE INVENTION

(a) Technical Field of the Invention

The present invention is generally related to antenna, and more particular to an antenna device having two antenna modules of orthogonal polarization directions.

(b) Description of the Prior Art

Mobile electronic devices such as smart phones have become vital accessories to people's daily lives. The mobile electronic devices require wireless communications to Internet for data queries, multimedia services, etc.

As these mobile electronic devices are required to be more powerful and complicated yet to be thinner and smaller, they are designed to pack multiple modules together within a limited space. However, for multiple sets of antennas in a single limited space, there is usually mutual interference, thereby compromising signal transmission and reception qualities.

But having multiple sets of antennas is inevitable if the mobile electronic devices have to enhance their wireless signal transmission and reception performance. As such, the interferences will be more severe as there are more antennas squeezed into the limited space of the mobile electronic devices.

Therefore, packing multiple sets of antennas in a limited space while avoiding their mutual interference becomes a major issue to be addressed by the present invention.

SUMMARY OF THE INVENTION

The present invention teaches an antenna device including a first antenna module, a second antenna module, and a first metallic plate. The first antenna module includes a number of first antennas electrically connected to and disposed at intervals at a distance from the first metallic plate. The second antenna module includes a number of second antennas electrically connected to and disposed at intervals on the first metallic plate within a space surrounded by the first antennas. The first and second antennas are of different polarization directions. In one embodiment, the first antennas are horizontally polarized antennas having omnidirectional field patterns. The second antennas are inverted F antennas having a greater portion of vertical polarization.

The gist of the present invention lies in arranging the first antennas of the first antenna module along an outer ring whereas arranging the second antennas of the second antenna module along an inner ring so as to maximize the distance between the first and second antenna modules on the first metallic plate. Furthermore, by having the first and second antennas with orthogonal polarization directions, the mutual interference between the radiation energy of the first and second antenna modules is effectively reduced.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
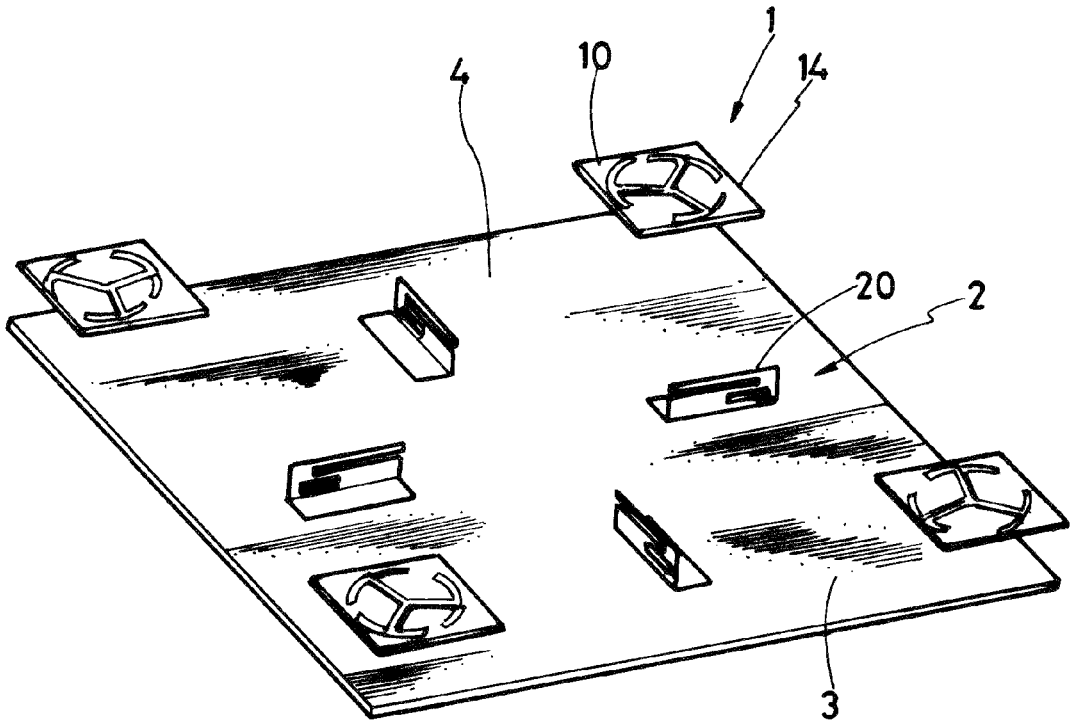
FIG. 1 is a schematic diagram showing an antenna device according to a first embodiment of the present invention.
Figure 4:
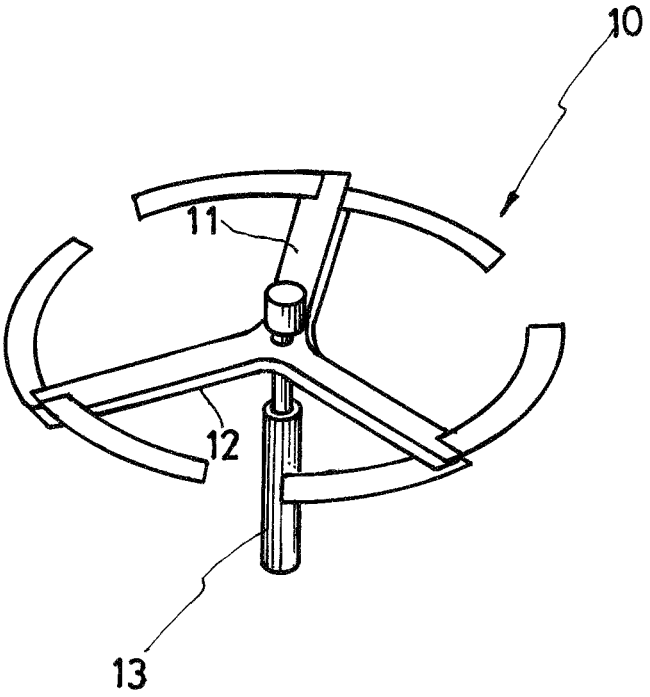
FIG. 4 is a schematic diagram showing a first antenna of the antenna device of FIG. 1.
Figure 5:
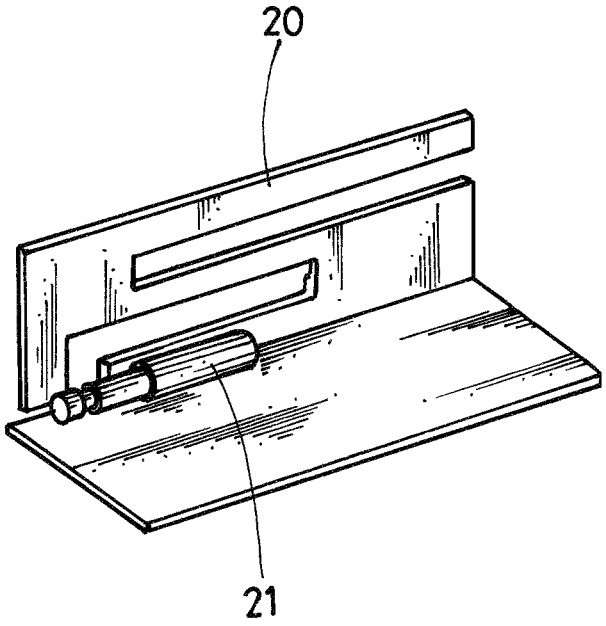
FIG. 5 is a schematic diagram showing a second antenna of the antenna device of FIG.

As shown in FIGS. 1, 4 and 5, an antenna device according to a first embodiment of the present invention includes a first antenna module 1, a second antenna module 2, and a first metallic plate 3. The first metallic plate 3 may be a circuit board or a plate of any material having a metallic surface.

The first antenna module 1 includes a number of first antennas 10 disposed at a distance above and electrically connected to the first metallic plate 3. The first antennas 10 are arranged at intervals surrounding a space 4 above the first metallic plate 3.

The first antennas 10 may be horizontally polarized antennas having omnidirectional field patterns. In the present embodiment, each first antenna 10 includes a first radiator 11 and a second radiator 12 stacked together with a distance therebetween. A feed terminal of the first and second radiators 11 and 12 is electrically connected to the first metallic plate 3 through a first signal transmission wire 13.

The first metallic plate 3 has a number of positioning elements (not numbered) so that each first antenna 10 is structurally joined to the first metallic plate 3 at a distance through a positioning element. Alternatively, each first antenna 10 has an insulating positioning element (not numbered) disposed between each first antenna 10 and the first metallic plate 3 so that each first antenna 10 is structurally joined to the first metallic plate 3 at a distance. In an embodiment, the first and second radiators 11 and 12 of each first antenna 10 may be positioned above and beneath a circuit board 14, respectively.

The second antenna module 2 includes a number of second antennas 20 structurally joined to the first metallic plate 3. The second antennas 20 are arranged at intervals within the space 4 surrounded by the first antennas 10. In the present embodiment, as shown in FIG. 1, each second antenna 20 is positioned axially aligned with a radial direction between two neighboring first antennas 10 from a center of the space 4 so that the first and second antennas 10 and 20 are alternately positioned. Each second antenna 20 is an inverted F antenna having a greater portion of vertical polarization. Each second antenna 20 is vertically configured on the first metallic plate 3 with a feed terminal electrically connected to the first metallic plate 3 through a second signal transmission wire 21.

The first antennas 10 are arranged in a ring along a periphery of the first metallic plate 3. The second antennas 20 are arranged in an inner ring within the space 4 surrounded by the first antennas 10. The first antennas 10 along the outer ring and the second antennas 20 along the inner ring are interleaved so that the distance between the first and second antenna modules 1 and 2 are maximized within the limited space of the first metallic plate 3. In addition, the first antennas 10 are horizontally polarized antennas with omnidirectional field patterns, meaning that the first antennas 10 radiate with horizontal polarization. On the other hand, the second antennas 20 are inverted F antennas, meaning that the second antennas 20 radiate with a greater portion of vertical polarization. By making the second antennas 20's vertical polarization greater than that of the first antennas 10 so that the first and second antennas 10 and 20 are generally of orthogonal polarization directions, the mutual interference between the radiation energy of first and second antenna modules 1 and 2 is effectively reduced.

Figure 6:
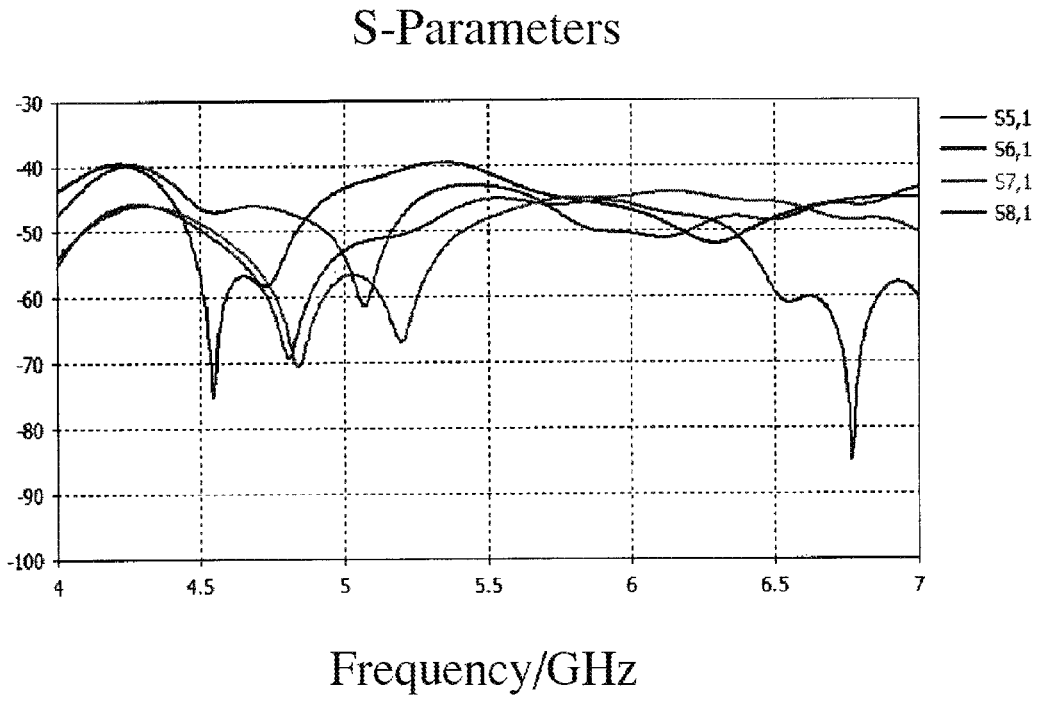
FIG. 6 is a chart showing measured isolation data between first antennas and a second antenna of the antenna device of FIG. 1.

FIG. 6 shows isolation data between a number of first antennas 10 (named as S5, S6, S7, and S8 in FIG. 6) and a second antenna 20 (the leftmost one in FIG. 1 named as 1 in FIG. 6). As depicted, the isolation between the first and second antenna modules 1 and 2 can reach about −40 dB, demonstrating the effective reduction of interference between the first and second antenna modules 1 and 2.

Figure 2:
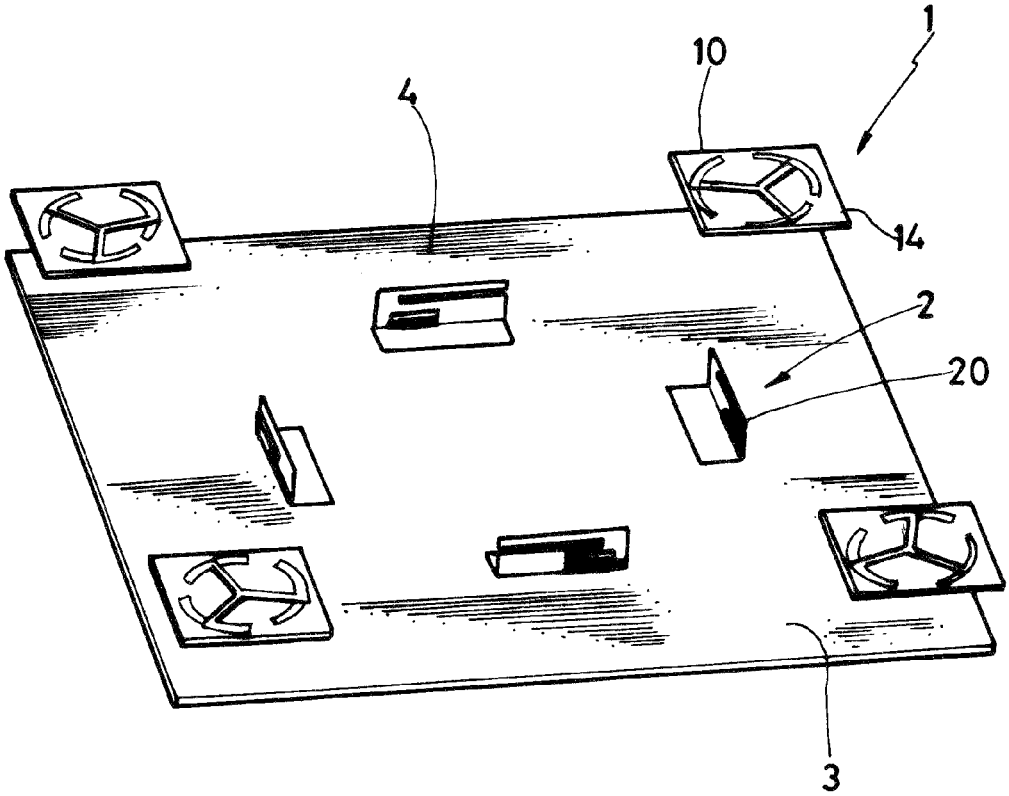
FIG. 2 is a schematic diagram showing an antenna device according to a second embodiment of the present invention.

FIG. 2 shows a second embodiment of the present invention where the second antennas 20 are electrically connected to the first metallic plate 3 and arranged at intervals end-to-end into a ring within the space 4 surrounded by the first antenna module 1.

Figure 3:
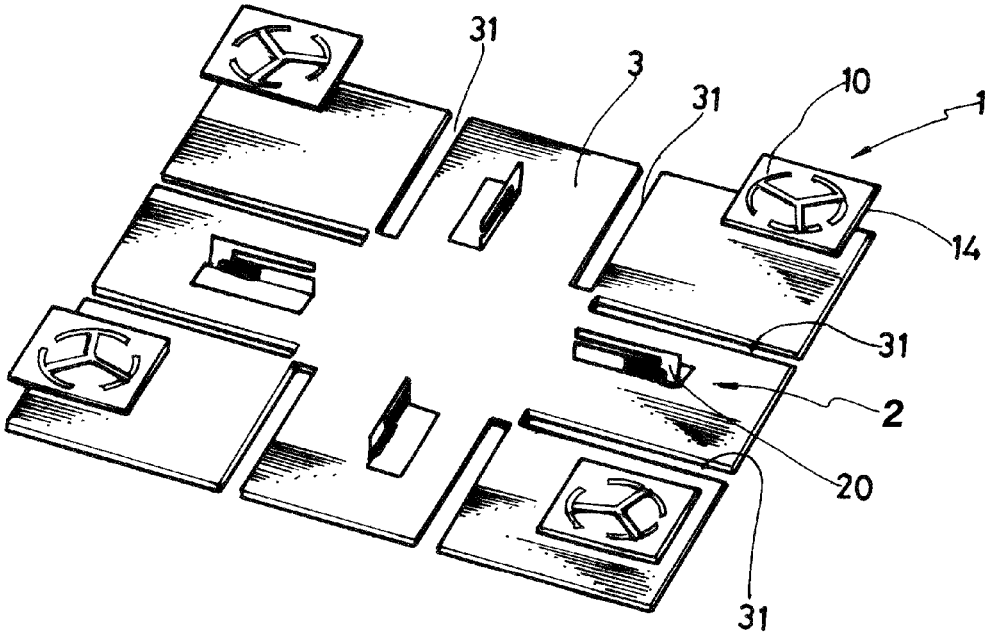
FIG. 3 is a schematic diagram showing an antenna device according to a third embodiment of the present invention.

FIG. 3 show a third embodiment of the present invention. In the present embodiment, at least a slot 31 which may be of any shape is formed between each pair of neighboring first antenna 10 and second antenna 20 on the first metallic plate 3 so as to further increase the isolation between the first and second antenna modules 1 and 2.

Figure 7:
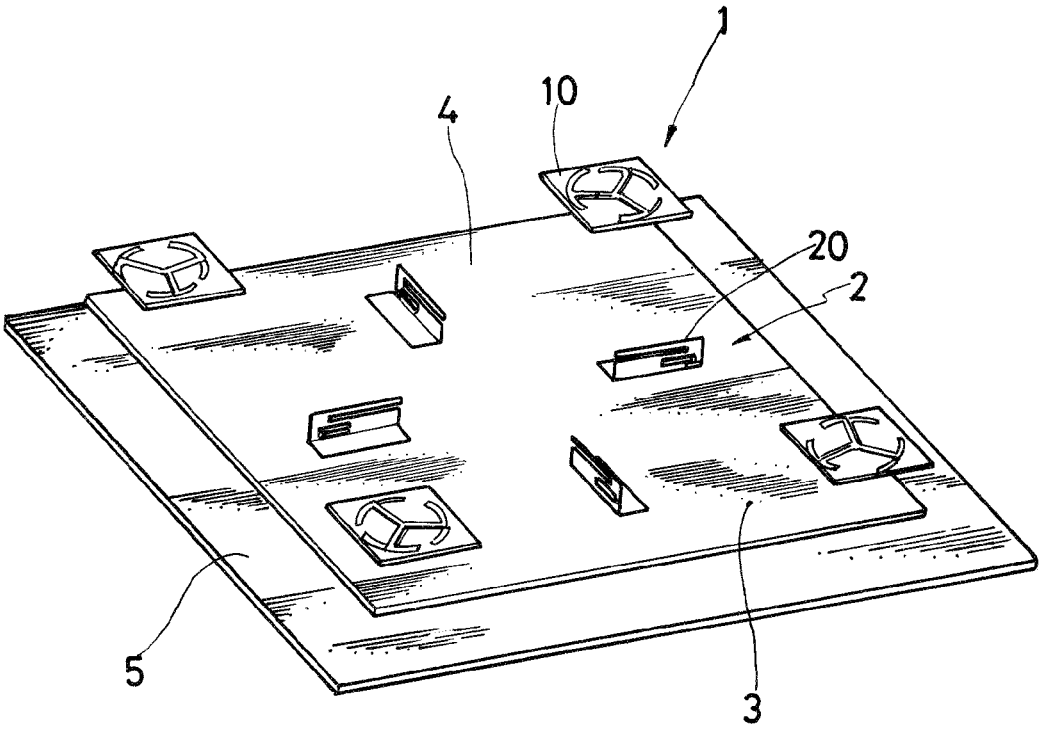
FIG. 7 is a schematic diagram showing an antenna device according to a fourth embodiment of the present invention.

FIG. 7 shows a fourth embodiment of the present invention. As illustrated, the antenna device further includes a second metallic plate 5 which may be a circuit board or a plate of any material having a metallic surface. The second metallic plate 5 is joined to a bottom side of the first metallic plate 3. In the present embodiment, the first metallic plate 3 is a plate with a metallic surfaced and the second metallic plate 5 is a circuit board. The first and second antennas 10 and 20 are electrically connected to the second metallic plate 5 through the first and second signal transmission wires 13 and 21, respectively.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. An antenna device, comprising a first antenna module comprising a plurality of first antennas disposed at intervals surrounding a space; and a second antenna module comprising a plurality of second antennas disposed at intervals within the space surrounded by the first antennas;

wherein each second antenna is positioned between a pair of neighboring first antennas so that the first and second antennas are alternately arranged; and the second antennas' have a greater portion of vertical polarization than that of the first antennas;

wherein the first antennas are horizontally polarized antennas having omnidirectional field patterns; the second antennas are inverted F antennas;

and the first and second antennas are generally of orthogonal polarization directions.

2. The antenna device according to claim 1, wherein each second antenna is positioned axially aligned with a radial direction between two neighboring first antennas from a center of the space.

3. The antenna device according to claim 1, wherein the second antennas are arranged at intervals end-to-end into a ring within the space surrounded by the first antennas.

4. The antenna device according to claim 1, further comprising a first metallic plate, wherein the first metallic plate is a circuit board having a metallic surface; the first antennas are electrically connected to the first metallic plate at a distance above the first metallic plate; and the second antennas are vertically configured on the first metallic plate.

5. The antenna device according to claim 4, wherein at least a slot is formed on the first metallic plate between each pair of neighboring first and second antennas.

6. The antenna device according to claim 4, wherein the first metallic plate has a plurality of positioning elements so that each first antenna is structurally joined to the first metallic plate at a distance through a positioning element.

7. The antenna device according to claim 4, wherein each first antenna has an insulating positioning element disposed between each first antenna and the first metallic plate so that each first antenna is structurally joined to the first metallic plate at a distance.

8. The antenna device according to claim 4, wherein each first antenna comprises a first radiator and a second radiator stacked together with a distance therebetween; a feed terminal of the first and second radiators is electrically connected to the first metallic plate through a first signal transmission wire; the first and second radiators of each first antenna may be positioned above and beneath a circuit board, respectively; and each second antenna has a feed terminal electrically connected to the first metallic plate through a second signal transmission wire.

9. The antenna device according to claim 1, further comprising a first metallic plate and a second metallic plate; the first metallic plate is a plate having a metallic surface; the second metallic plate is a circuit board with a metallic surface; the second metallic plate is joined to a bottom side of the first metallic plate; the first antennas are positioned at a distance from the first metallic plate; the second antennas are vertically configured on the first metallic plate; and the first and second antennas are electrically connected to the second metallic plate.

* * * * *